US007971569B2

(12) United States Patent
Meistrick et al.

(10) Patent No.: US 7,971,569 B2
(45) Date of Patent: Jul. 5, 2011

(54) BIAS SYSTEM FOR DEDICATED ENGINE BRAKING ROCKER ARM IN A LOST MOTION SYSTEM

(75) Inventors: Zdenek S. Meistrick, West Granby, CT (US); Joseph A. Bonfatto, Bloomfield, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 153 days.

(21) Appl. No.: 12/533,702

(22) Filed: Jul. 31, 2009

(65) Prior Publication Data

US 2010/0108026 A1 May 6, 2010

Related U.S. Application Data

(60) Provisional application No. 61/129,947, filed on Jul. 31, 2008.

(51) Int. Cl.
*F02D 13/04* (2006.01)

(52) U.S. Cl. ..... 123/321; 123/90.15; 123/90.16

(58) Field of Classification Search ..... 123/321, 123/90.12, 90.15–90.18
See application file for complete search history.

(56) References Cited

U.S. PATENT DOCUMENTS 6,691,674 B2 * 2/2004 McCarthy et al. ..... 123/321
7,827,958 B2 * 11/2010 Dietrich et al. ..... 123/321
7,882,810 B2 * 2/2011 Vanderpoel et al. ..... 123/90.12
2005/0252484 A1 11/2005 Vanderpoel
2007/0144472 A1 6/2007 Yang

OTHER PUBLICATIONS

Hope A. Bolton and Jay M. Larson, Valvetrain System Design and Materials, "A Chronology of Hydraulic Lash Compensation in the United States" by W.A. Dammers (Eaton Corporation, Marshall, Michigan), International Symposium on Valvetrain System Design and Materials, Apr. 14-15, 1997, pp. 27-41, ASM International, Materials Park, Ohio, United States of America.

* cited by examiner

*Primary Examiner* — Erick Solis
(74) *Attorney, Agent, or Firm* — David R. Yohannan; Kelley Drye & Warren LLP

(57) ABSTRACT

A lost motion valve actuation system includes an engine brake housing and one or more hydraulic fluid supply passages extending through the housing. Master and slave pistons are slidably disposed corresponding bores in the housing. The master and slave pistons are used to provide selective actuation to one or more engine valves. An engine brake rocker arm disposed adjacent to the housing includes a master piston contact surface and a bias mechanism contact surface. A bias mechanism is disposed in the housing and includes a bias piston which extends from the housing. The bias piston biases the rocker arm out of contact with an engine cam during select engine operation modes, such as during a positive power mode of operation. The bias piston may be mechanically or hydraulically repositioned to permit the rocker arm to contact the engine cam during a second mode of engine operation, such as an engine braking mode.

8 Claims, 7 Drawing Sheets

BIAS SYSTEM FOR DEDICATED ENGINE BRAKING ROCKER ARM IN A LOST MOTION SYSTEM

CROSS-REFERENCE TO RELATED APPLICATIONS

The present invention and application relates to, and claims the benefit of the earlier filing date and priority of U.S. Provisional Patent Application No. 61/129,947 filed Jul. 31, 2008, for Bias System for Dedicated Engine Braking Rocker Arm in a Lost Motion System.

FIELD OF THE INVENTION

The present invention relates generally to systems and methods for actuating an engine valve in an internal combustion engine for engine braking. In particular, the present invention relates to systems and methods that may bias a rocker arm into a predetermined position during a non-engine braking mode of operation of an internal combustion engine.

BACKGROUND OF THE INVENTION

In an internal combustion engine, engine valve actuation is required in order to produce positive power, and may also be used to produce engine braking and/or exhaust gas recirculation (EGR). During positive power, one or more intake valves may be opened to admit air into a cylinder for combustion during the intake stroke of the piston. One or more exhaust valves may be opened to allow combustion gases to escape from the cylinder during the exhaust stroke of the piston.

One or more exhaust valves may also be selectively opened to convert, at least temporarily, the engine into an air compressor for engine braking operation. This air compressor effect may be accomplished by either opening one or more exhaust valves near piston top dead center (TDC) position for compression-release type braking, or by maintaining one or more exhaust valves in a relatively constant cracked open position during much or all of the piston motion, for bleeder type braking. In either of these methods, the engine may develop a retarding force that may be used to help slow a vehicle down. This braking force may provide the operator with increased control over the vehicle, and may also substantially reduce the wear on the service brakes. Compression-release type engine braking has been long known and is disclosed in Cummins, U.S. Pat. No. 3,220,392 (November 1965), which is hereby incorporated by reference.

One proposed method of adjusting valve timing and lift to selectively provide engine braking, given a fixed cam profile, has been to incorporate a "lost motion" device in the valve train linkage between the engine valve and the cam that provides the engine braking motion. Lost motion is the term applied to a class of technical solutions for modifying the valve motion proscribed by a cam profile with a variable length mechanical, hydraulic, or other linkage assembly. In a lost motion system, a cam lobe may provide the "maximum" (longest dwell and greatest lift) motion needed for an engine valve event, such as engine braking. A variable length system may then be included in the valve train linkage, intermediate of the valve to be opened and the cam providing the maximum motion, to subtract or lose part or all of the motion imparted by the cam to the valve.

This variable length system (or lost motion system) may, when expanded fully, transmit all of the cam motion to the valve (e.g., for engine braking), and when contracted fully, transmit none or a minimum amount of the cam motion to the valve. An example of such a system and method is provided in Hu, U.S. Pat. Nos. 5,537,976 and 5,680,841, which are assigned to the same assignee as the present application and which are incorporated herein by reference.

In the lost motion system of U.S. Pat. No. 5,680,841, an engine cam shaft may actuate a master piston which displaces fluid from its hydraulic chamber into a hydraulic chamber of a slave piston. The slave piston in turn acts on the engine valve to open it. The lost motion system may include a solenoid trigger valve in communication with the hydraulic circuit that includes the chambers of the master and slave pistons. The solenoid valve may be maintained in a closed position in order to retain hydraulic fluid in the circuit when the master piston is acted on by certain of the cam lobes. As long as the solenoid valve remains closed, the slave piston and the engine valve respond directly to the hydraulic fluid displaced by the motion of the master piston, which reciprocates in response to the cam lobe acting on it. When the solenoid is opened, the circuit may drain, and part or all of the hydraulic pressure generated by the master piston may be absorbed by the circuit rather than be applied to displace the slave piston and the engine valve.

The braking power of a compression-release type engine brake may be increased by selectively actuating the exhaust valves to carry out brake gas recirculation in combination with compression release braking. Brake gas recirculation (BGR) can be accomplished by opening an exhaust or auxiliary valve near bottom dead center of the intake or expansion stroke of the piston and keeping the exhaust or auxiliary valve open during the first portion of the exhaust or compression stroke of the engine. Opening the exhaust or auxiliary valve during this portion of the engine cycle may allow exhaust gas to flow into the engine cylinder from the relatively higher pressure exhaust manifold. The introduction of exhaust gases from the exhaust manifold into the cylinder may increase the total gas mass and gas pressure in the cylinder at the time of the immediately following compression-release event. This increased gas mass and pressure in the engine cylinder may increase the braking power produced by the compression-release event.

There are many different systems that may be used to selectively actuate an exhaust or auxiliary valve to produce BGR and compression-release events. One known type of actuation system is a lost motion system, described in the aforenoted Cummins patent. An example of a lost motion system and method used to obtain engine braking and brake gas recirculation is disclosed in Gobert, U.S. Pat. No. 5,146,890 (Sep. 15, 1992) which discloses a method of conducting brake gas recirculation by placing the cylinder in communication with the exhaust system during the first part of the compression stroke and optionally also during the latter part of the intake stroke, and which is hereby incorporated by reference. Gobert uses a lost motion system to enable and disable compression-release braking and brake gas recirculation. The system disclosed in Gobert opens the exhaust valve near bottom dead center of the intake stroke for a BGR event, closes the exhaust valve before the midway point of the compression stroke to terminate the BGR event, and opens the exhaust valve again near top dead center of the same compression stroke for a compression-release event. As a result, the exhaust valve actuated in accordance with the Gobert system must be rapidly seated and unseated between the BGR and compression-release events.

In many internal combustion engines, the intake and exhaust valves may be actuated by fixed profile cams, and more specifically, by one or more fixed lobes that are an integral part of each cam. The cams may include a lobe for each valve event that the cam is responsible for providing. The size and shape of the lobes on the cam may dictate the valve lift and duration which result from the lobe. For example, an exhaust cam profile for a system constructed in accordance with the aforenoted Gobert patent may include a lobe for a BGR event, a lobe for a compression-release event, and a lobe for a main exhaust event.

Compression-release engine braking is not the only type of engine braking known. The operation of a bleeder type engine brake has also long been known. During bleeder type engine braking, in addition to the normal exhaust valve lift, the exhaust valve(s) may be held slightly open continuously throughout the remaining engine cycle (full-cycle bleeder brake) or during a portion of the cycle (partial-cycle bleeder brake). The primary difference between a partial-cycle bleeder brake and a full-cycle bleeder brake is that the exhaust valve is closed for the former during most of the intake stroke.

Usually, the initial opening of the braking valve(s) in a bleeder braking operation is far in advance of the compression TDC (i.e., early valve actuation) and then lift is held constant for a period of time. As such, a bleeder type engine brake may require much lower force to actuate the valve(s) due to early valve actuation, and generates less noise due to continuous bleeding instead of the rapid blow-down of a compression-release type brake. Moreover, bleeder brakes often require fewer components and can be manufactured at lower cost. Thus, an engine bleeder brake can have significant advantages.

Some lost motion system used for engine braking may utilize a dedicated cam lobe to actuate a rocker arm to perform engine braking and/or some other engine valve actuation. Examples of such systems are disclosed in U.S. Pat. Nos. 7,392,772 and 5,975,251, which are incorporated by reference herein. In dedicated cam engine braking systems, it may be desirable to maintain a lash space between the cam and the rocker arm used to actuate the engine valve for engine braking when the engine is not providing engine braking (i.e., during positive power operation of the engine). U.S. Pat. Nos. 7,392,772 and 5,975,251 both disclose mechanisms for biasing a rocker arm away from a dedicated engine braking cam lobe during positive power. The biasing mechanisms disclosed in the foregoing patents, however, both require that hydraulic fluid passages be provided in the rocker arms themselves. Providing hydraulic passages within rocker arms, and supplying such passages with hydraulic fluid may be difficult and add expensive to an engine braking system.

Accordingly, it is an advantage of some, but not necessarily all, embodiments of the present invention to provide non-hydraulic means for biasing a rocker arm away from a dedicated cam, and/or to provide a hydraulic means for biasing a rocker arm away from a dedicated cam wherein the hydraulic means is not incorporated into a rocker arm. Additional advantages of the invention are set forth, in part, in the description that follows and, in part, will be apparent to one of ordinary skill in the art from the description and/or from the practice of the invention.

SUMMARY OF THE INVENTION

Responsive to the foregoing challenges, Applicants have developed an innovative lost motion valve actuation system comprising: an engine brake housing; one or more hydraulic fluid supply passages extending through the housing; a solenoid valve communicating with at least one of said fluid supply passages; a master piston slidably disposed in a master piston bore provided in the housing wherein said master piston bore communicates with at least one of said fluid supply passages; a slave piston slidably disposed in a slave piston bore provided in the housing wherein said slave piston bore is connected to said master piston bore by a fluid passage; an engine brake rocker arm disposed on a rocker shaft, said rocker arm having a master piston contact surface and a bias mechanism contact surface; a bias mechanism disposed in the housing, said bias mechanism including a bias piston disposed within a bias piston bore extending through said housing and wherein said bias piston extends from said housing to contact with said bias mechanism contact surface; a control valve communicating with at least one of said fluid supply passages; and a cam having a cam lobe adapted to impart engine braking motion to said rocker arm.

Applicants have further developed innovative lost motion valve actuation systems having: a bias mechanism comprising a bias piston spring adapted to bias a bias piston towards the bias piston contact surface of a rocker arm; at least one hydraulic fluid supply passage communicating with a bias piston bore; a cam lobe which is an engine braking cam lobe; a cam includes a braking cam lobe and a brake gas recirculation cam lobe; a hydraulically actuated bias mechanism; a solenoid valve communicating with fluid supply passages and a plurality of master piston bores; and/or a pressurized source of hydraulic fluid connected to the one or more hydraulic fluid passages wherein a bias force exerted by a bias piston spring on the bias piston is less than a pressure force exerted by a pressurized source of hydraulic fluid on the bias piston.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements.

DETAILED DESCRIPTION OF EMBODIMENTS OF THE INVENTION

As embodied herein, the present invention includes both systems and methods of actuating engine valves, particularly exhaust or auxiliary engine valves, for engine braking. It is appreciated, however, that embodiments of the present invention may be used to actuate intake engine valves. Reference will now be made in detail to a first embodiment of the present invention, an example of which is illustrated in the accompanying drawings. A first embodiment of the present invention is shown in FIGS. 1-3 and 7, as valve actuation system 10.

Figure 1:
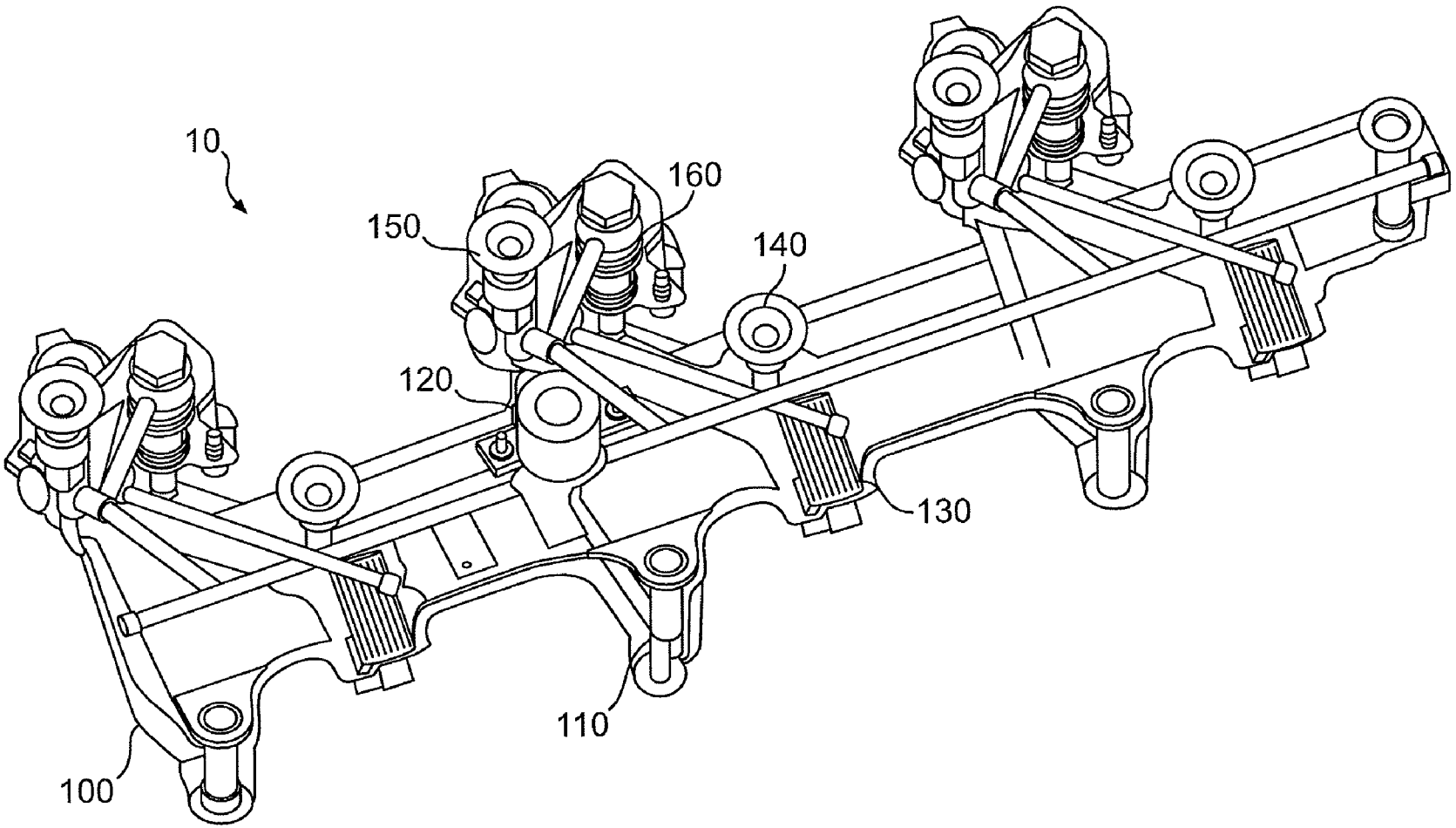
FIG. 1 is a three dimensional view of a lost motion valve actuation system used to provide engine braking according to a first embodiment of the present invention.

With reference to FIGS. 1-3 and 7, the system 10 may include a fixed housing 100 including one or more internal hydraulic fluid supply passages 110. The one or more internal hydraulic fluid supply passages 110 may connect a master piston 130 and a slave piston 160 to a hydraulic fluid supply 330. The supply passages 110 may extend from the fluid supply 330 past an on/off solenoid valve 120 and past a control valve 150. The on/off control of the solenoid valve 120 may be used to selectively provide low pressure hydraulic fluid to the one or more hydraulic fluid supply passages 110 extending between the master pistons 130, the engine brake control valves 150, and the slave pistons 160 included in the system 10 using the hydraulic fluid pump 340. Three of each of the foregoing elements are shown in FIG. 1 and are part of the system 10.

Figure 7:
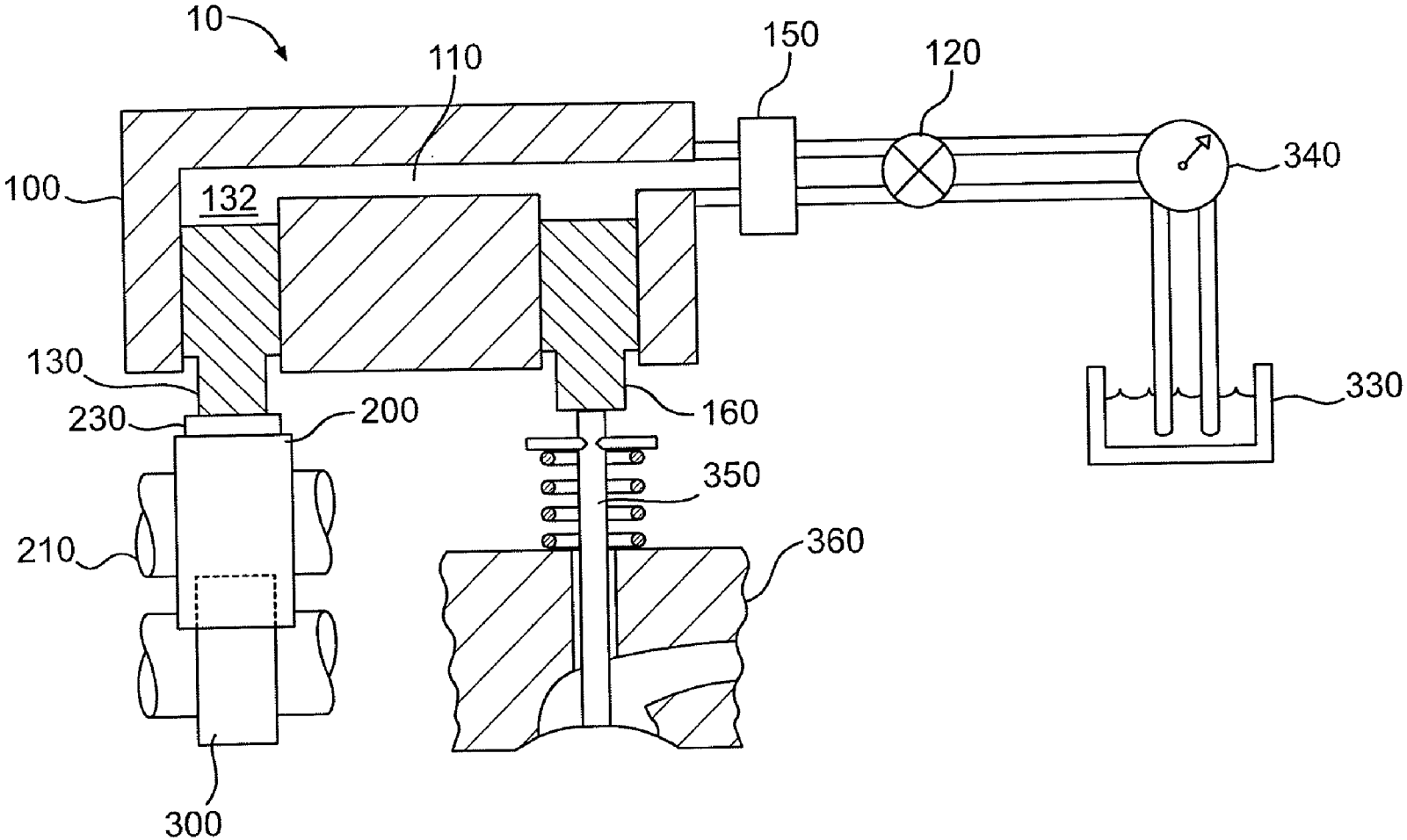
FIG. 7 is a schematic illustration of a master and slave lost motion system of the type in which embodiments of the invention may be incorporated.

The slave piston 160 may contact an engine valve 350 slidably disposed in an engine valve head 360. The slave piston 160 is shown in FIG. 7 to contact the engine valve 350 directly, but it is appreciated that any known valve train element, such as a valve bridge, could be disposed between the slave piston and the engine valve without departing from the intended scope of the present invention. The engine valve 350 may be selectively actuated to open and close as a result of movement of the slave piston 160 under the influence of the master piston 130.

Figure 2:
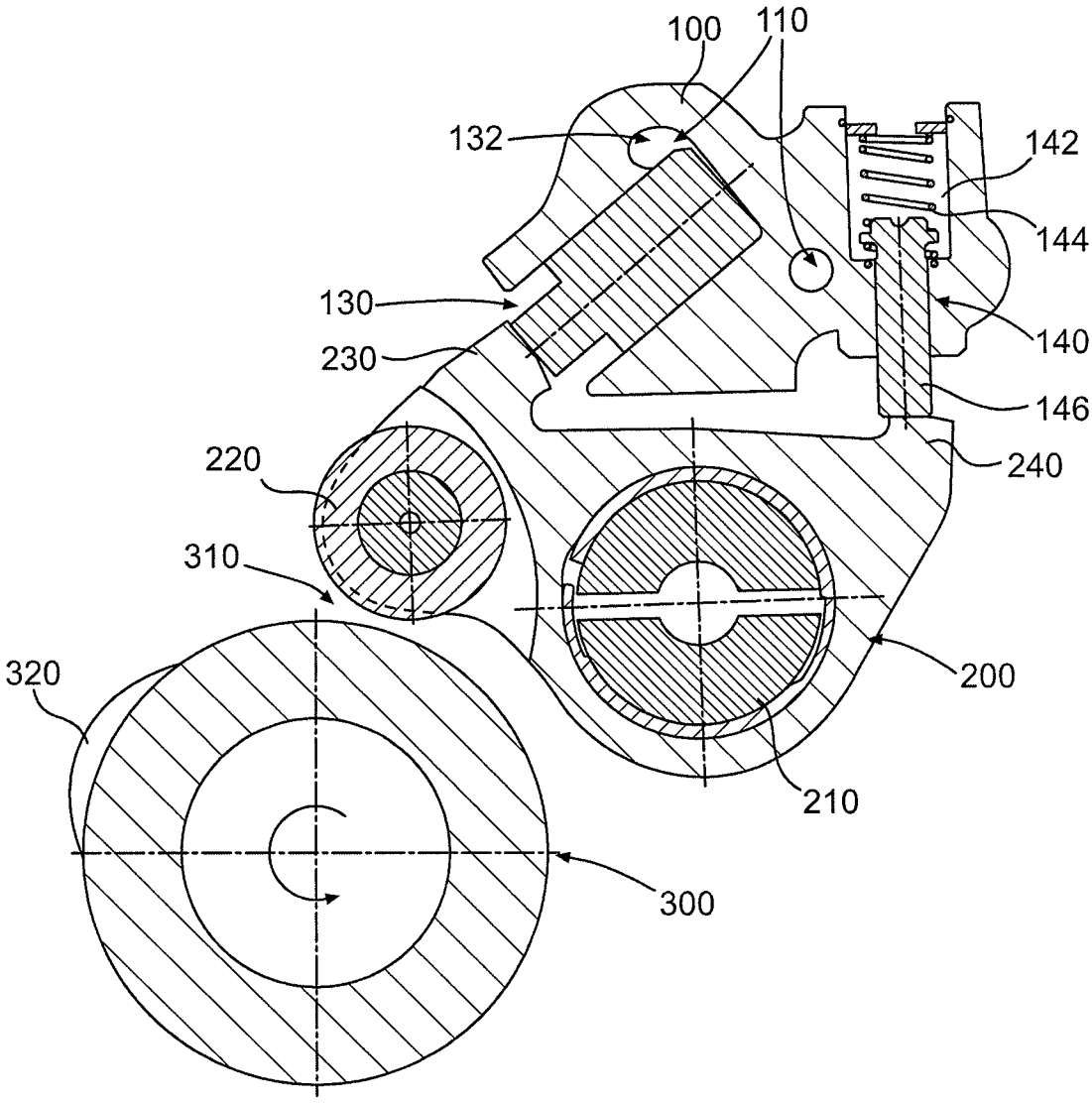
FIG. 2 is a cross-sectional view of the lost motion valve actuation system shown in FIG. 1 during a non-engine braking mode of engine operation.

With reference to FIGS. 1-2 and 7, a dedicated rocker arm (which may be a dedicated engine braking rocker arm) 200 may be pivotally mounted on a rocker shaft 210. The rocker arm 200 may include a cam roller 220, a master piston contact surface 230, and a bias piston contact surface 240. A cam shaft including one or more cams 300 may be rotationally mounted adjacent to the rocker arm 200. The cam 300 may include one or more lobes 320 which provide engine valve actuation motion, such as engine braking and optionally BGR valve actuation. During a first mode of engine operation, e.g., a positive power mode of engine operation when the system 10 provides engine braking, a lash space 310 may be provided between the cam 300 and the cam roller 220. The lash space 310 may be the same or greater than the height of the cam lobe 320 during the non-braking mode of engine operation.

The fixed housing 100 may be mounted over and adjacent to the rocker arm 200. The housing 100 may include one or more hydraulic fluid passages 110, which among other things, deliver low pressure hydraulic fluid to a master piston bore 132 in which the master piston 130 is slidably disposed.

The fixed housing 100 may also include a bias mechanism 140 comprising a bias piston bore 142 in which a bias piston 146 is slidably disposed. The bias piston 146 may have an elongated lower portion and an upper head portion, and may extend through the housing 100 into selective contact with the bias piston contact surface 240 of the rocker arm 200. The bias piston 146 may be biased downward toward the rocker arm 200 by a bias piston spring 144. The bias force of the spring 144 may be selected to be less than the force exerted on the master piston 130 by the low pressure hydraulic fluid that may be selectively supplied to the master piston bore 132 through the hydraulic fluid supply passages 110.

Figure 3:
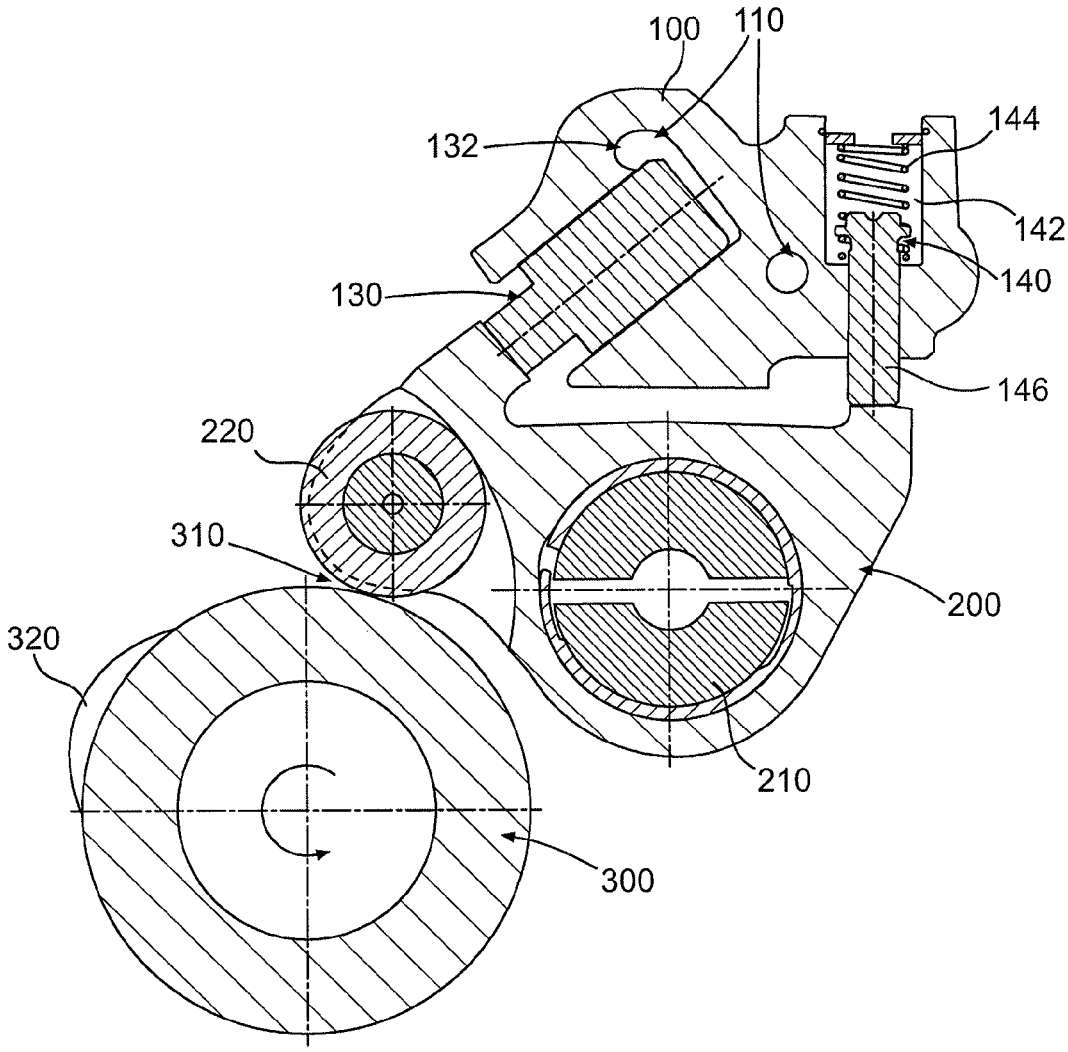
FIG. 3 is a cross-sectional view of the lost motion valve actuation system shown in FIG. 2 during an engine braking mode of engine operation.

Operation of the system 10 shown in FIGS. 1-3 and 7 is explained with reference to FIGS. 2 and 3. With reference to FIG. 2, during a first mode of engine operation, e.g., during positive power operation of the engine at which time no engine braking is desired, the solenoid valve 120 (FIGS. 1 and 7) may be maintained in a position which prevents low pressure hydraulic fluid from being provided to the master piston bore 132. As a result, the bias force of the bias spring 144 may force the bias piston 146 downward so that it presses against the bias piston contact surface 240 of the rocker arm 200. In turn, the rocker arm 200 may be rotated clock-wise such that the master piston 130 is pushed into the master piston bore 132 and such that the lash space 310 is maintained in its maximum state. As a result, the cam lobe 320 may impart a reduced amount, or preferably no, motion to the rocker arm 200, which in turn results in no engine braking valve actuation being transmitted from the master piston 130 to the slave piston 160 (shown in FIG. 1).

With reference to FIG. 3, during a second mode of engine operation, e.g., engine braking operation of the engine, the solenoid valve 120 may be maintained in a position which permits low pressure hydraulic fluid to be supplied to the master piston bore 132. The hydraulic fluid provided from the solenoid valve 120 may flow through a control valve 150 (FIGS. 1 and 7) which includes a check valve and permits only one-way flow of fluid. As a result, the bias force of the bias spring 144 is overcome by the force exerted by the master piston 130 on the rocker arm 200. More specifically, hydraulic fluid provided to the master piston bore 132 may cause the master piston 130 to be moved away from the inner wall of the master piston bore so that the master piston presses against the master piston contact surface 240 of the rocker arm 200. In turn, the rocker arm 200 may be rotated counter clock-wise such that the bias piston 146 is pushed upward against the bias of the spring 144 and such that the lash space 310 is eliminated or placed in its minimum state. As a result, the cam lobe 320 may impart an increased amount, or preferably all, of its motion to the rocker arm 200, which in turn results in engine braking valve actuation being transmitted from the master piston 130 to the slave piston 160 (shown in FIGS. 1 and 7). When it is desired to return from the second mode of engine operation to the first mode of engine operation, the solenoid valve 120 may be closed, which in turn may cause the control valve 150 to vent hydraulic pressure from the portion of the supply passages 110 in the housing 100.

Figure 4:
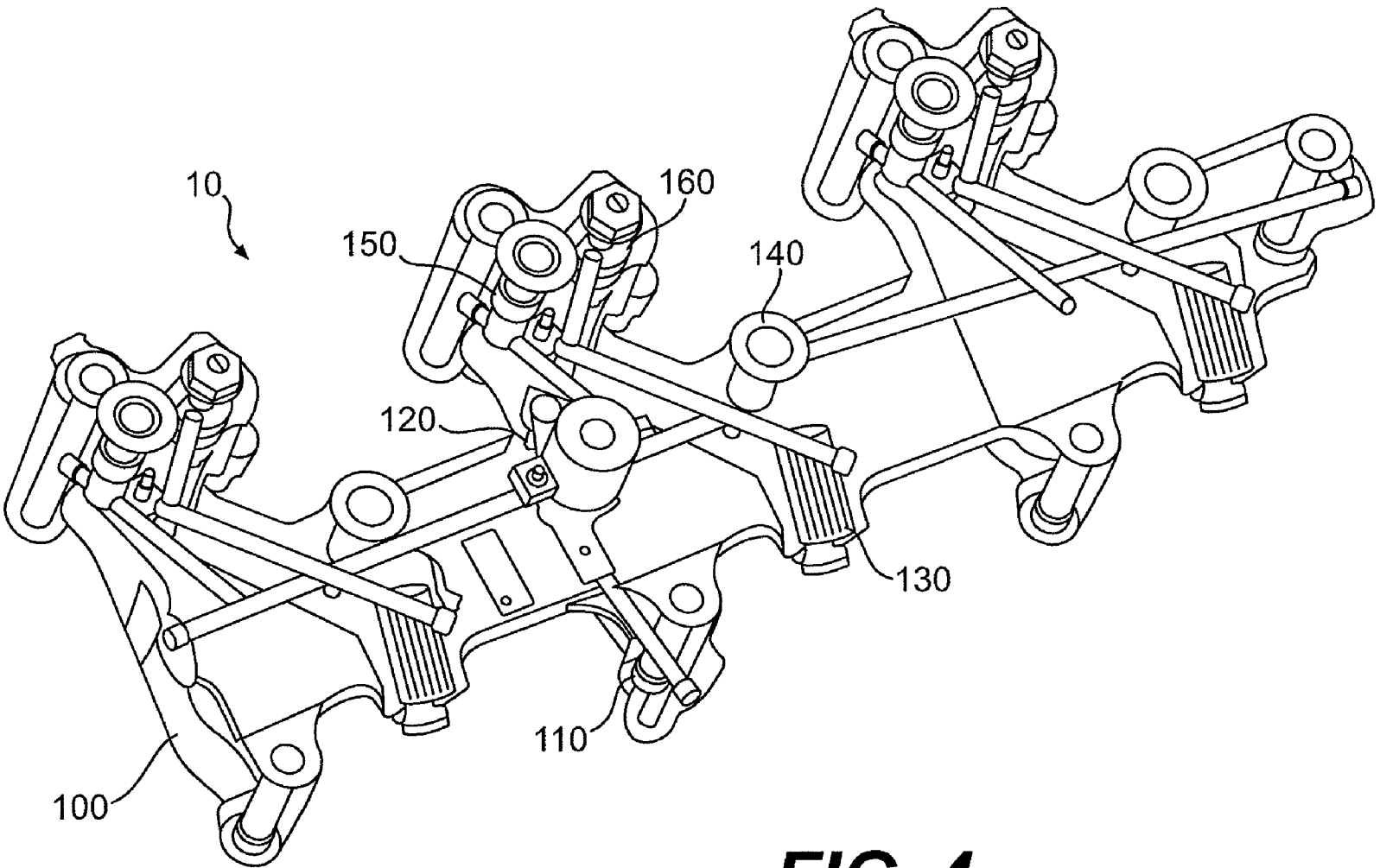
FIG. 4 is a three dimensional view of a lost motion valve actuation system used to provide engine braking according to a second embodiment of the present invention.

With reference to FIGS. 4 and 7, a second embodiment of the system 10 may include a fixed housing 100 including one or more internal hydraulic fluid supply passages 110. A first portion of the supply passages 110 may extend from a fluid supply 330 through the hydraulic fluid pump 340, through first to an on/off solenoid valve 120 and through the control valve 150. The on/off control of the solenoid valve 120 may be used to selectively provide low pressure hydraulic fluid to the remainder of the hydraulic fluid supply passages 110 extending between the master pistons 130, the bias mechanisms 140, the control valves 150, and the slave pistons 160 included in the system 10. Three of each of the foregoing elements are shown in FIG. 4 and part of the system 10.

Figure 5:
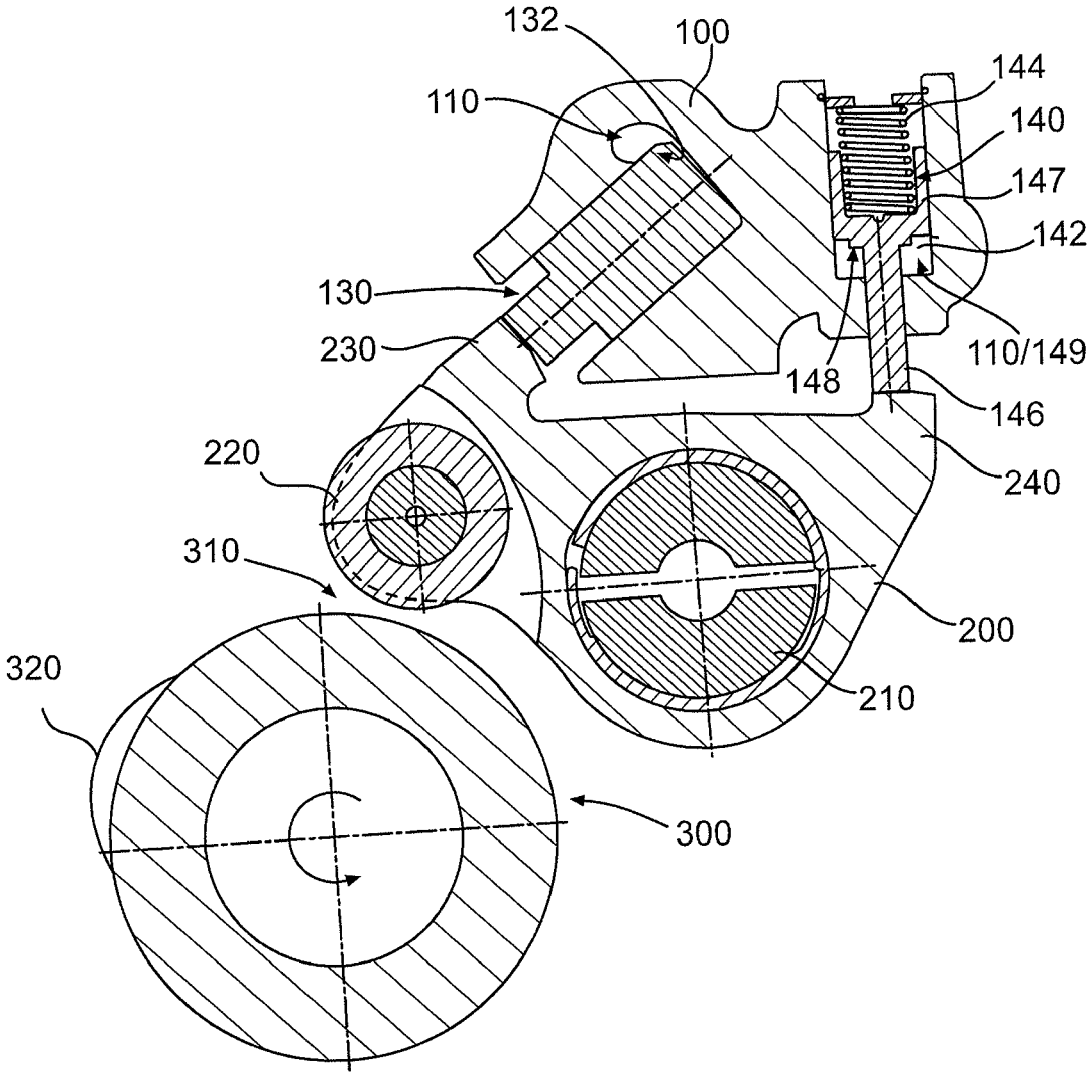
FIG. 5 is a cross-sectional view of the lost motion valve actuation system shown in FIG. 4 during a non-engine braking mode of engine operation.

With reference to FIGS. 4-5 and 7, a dedicated rocker arm (which may be a dedicated engine braking rocker arm) 200 may be pivotally mounted on a rocker shaft 210. The rocker arm 200 may include a cam roller 220, a master piston contact surface 230, and a bias piston contact surface 240. A cam shaft including one or more cams 300 may be rotationally mounted adjacent to the rocker arm 200. The cam 300 may include one or more lobes 320 which provide engine valve actuation motion, such as engine braking and optionally BGR valve actuation. During a first mode of engine operation, e.g., a positive power mode of engine operation when the system 10 provides engine braking, a lash space 310 may be provided between the cam 300 and the cam roller 220. The lash space 310 may be the same or greater than the height of the cam lobe 320 during the non-braking mode of engine operation.

The fixed housing 100 may be mounted over and adjacent to the rocker arm 200. The housing 100 may include one or more hydraulic fluid passages 110, which among other things, deliver low pressure hydraulic fluid to a master piston bore 132 in which the master piston 130 is slidably disposed.

The fixed housing 100 may also include a bias mechanism 140 comprising a bias piston bore 142 in which a bias piston 146 is slidably disposed. The bias piston 146 may have an elongated lower portion and an upper head portion 147, and may extend through the housing 100 into selective contact with the bias piston contact surface 240 of the rocker arm 200. The upper head portion 147 of the bias piston 146 may be cup-shaped to receive a bias spring 144. The upper head portion 147 may form a hydraulic seal with the wall of the bias piston bore 142 and define a space 149 between the upper head portion and the inner wall of the bias piston bore 142. The space 149 may be in hydraulic communication with the supply passage 110. The bias piston 146 may be biased downward toward the rocker arm 200 by the bias piston spring 144. The bias force of the spring 144 may be selected to be less than the force exerted on the master piston 130 and/or on the inner surface 148 of the bias piston by the low pressure hydraulic fluid that may be selectively supplied to the master piston bore 132 and the bias piston bore 142 through the hydraulic fluid supply passages 110.

Figure 6:
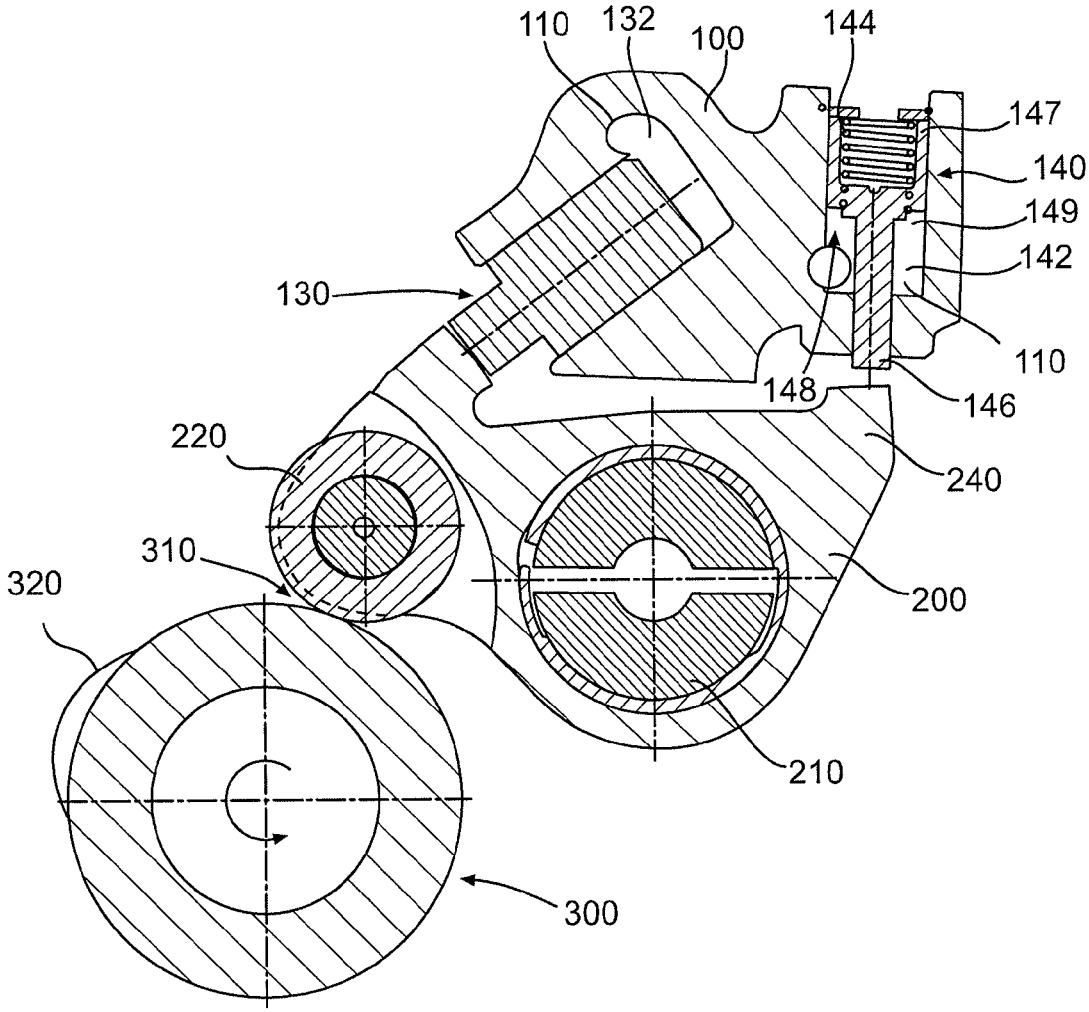
FIG. 6 is a cross-sectional view of the lost motion valve actuation system shown in FIG. 5 during an engine braking mode of engine operation.

Operation of the system 10 shown in FIGS. 4-7 is explained with reference to FIGS. 5 and 6. With reference to FIG. 5, during a first mode of engine operation, e.g., during positive power operation of the engine at which time no engine braking is desired, the solenoid valve 120 (FIGS. 4 and 7) may be maintained in a position which prevents low pressure hydraulic fluid from being provided to the master piston bore 132 and the space 149 in the bias piston bore 142. As a result, the bias force of the bias spring 144 may force the bias piston 146 downward so that it presses against the bias piston contact surface 240 of the rocker arm 200. In turn, the rocker arm 200 may be rotated clock-wise such that the master piston 130 is pushed into the master piston bore 132 and such that the lash space 310 is maintained in its maximum state. As a result, the cam lobe 320 may impart a reduced amount, or preferably no, motion to the rocker arm 200, which in turn results in no engine braking valve actuation being transmitted from the master piston 130 to the slave piston 160 (shown in FIG. 4).

With reference to FIG. 6, during a second mode of engine operation, e.g., engine braking operation of the engine, the solenoid valve 120 may be maintained in a position which permits low pressure hydraulic fluid to be supplied to the master piston bore 132 and the bias piston bore 148. The hydraulic fluid provided from the solenoid valve 120 may flow through a control valve 150 (FIGS. 4 and 7) which includes a check valve and permits only one-way flow of fluid. As a result, the bias force of the bias spring 144 may be overcome by the force exerted by the master piston 130 on the rocker arm 200 and/or by the force exerted on the bias piston 146 in the space 149 by the low pressure hydraulic fluid supplied through passages 110. More specifically, hydraulic fluid provided to the master piston bore 132 and hydraulic fluid provided to the space 149 in the bias piston bore 142 may cause the master piston 130 to be moved away from the inner wall of the master piston bore so that the master piston presses against the master piston contact surface 240 of the rocker arm 200, as well as cause the bias piston 146 to be moved upward and away from the bias piston contact surface 240 on the rocker arm. In turn, the rocker arm 200 may be rotated counter clock-wise such that the lash space 310 is eliminated or placed in its minimum state, and the bias piston may be pushed upwards such that it makes little or preferably no contact with the rocker arm 200. As a result, the cam lobe 320 may impart an increased amount, or preferably all, of its motion to the rocker arm 200, which in turn results in engine braking valve actuation being transmitted from the master piston 130 to the slave piston 160 (shown in FIG. 4). When it is desired to return from the second mode of engine operation to the first mode of engine operation, the solenoid valve 120 may be closed, which in turn may cause the control valve 150 to vent hydraulic pressure from the portion of the supply passages 110 in the housing 100.

It will be apparent to those skilled in the art that variations and modifications of the present invention can be made without departing from the scope or spirit of the invention. For example, the components and arrangement of the lost motion system 100, as shown in FIGS. 1-7 are for exemplary purposes only. It is contemplated that other components necessary for a properly operating lost motion system may be provided and that the arrangement of the master piston, the slave piston, the bias piston, the control valve and solenoid valve may vary depending on a variety of factors, such as, for example, the specification of the engine. Thus, it is intended that the present invention cover all such modifications and variations of the invention, provided they come within the scope of the appended claims and their equivalents.

What is claimed is:

1. A lost motion valve actuation system comprising:
- an engine brake housing;
- one or more hydraulic fluid supply passages extending through the housing;
- a solenoid valve communicating with at least one of said fluid supply passages;
- a master piston slidably disposed in a master piston bore provided in the housing wherein said master piston bore communicates with at least one of said fluid supply passages;
- a slave piston slidably disposed in a slave piston bore provided in the housing wherein said slave piston bore is connected to said master piston bore by a fluid passage;
- an engine brake rocker arm disposed on a rocker shaft, said rocker arm having a master piston contact surface and a bias mechanism contact surface;
- a bias mechanism disposed in the housing, said bias mechanism including a bias piston disposed within a bias piston bore extending through said housing and wherein said bias piston extends from said housing to contact with said bias mechanism contact surface;
- a control valve communicating with at least one of said fluid supply passages; and
- a cam having a cam lobe adapted to impart engine braking motion to said rocker arm.

2. The lost motion system of claim 1 wherein the bias mechanism comprises:
- a bias piston spring adapted to bias said bias piston towards the bias piston contact surface of the rocker arm.

3. The lost motion system of claim 1 wherein at least one of said hydraulic fluid supply passages communicates with said bias piston bore.

4. The lost motion system of claim 1 wherein the cam lobe is an engine braking cam lobe.

5. The lost motion system of claim 1 wherein the cam includes a braking cam lobe and a brake gas recirculation cam lobe.

6. The lost motion system of claim 1 wherein the bias mechanism is hydraulically actuated.

7. The lost motion system of claim 1 wherein the solenoid valve communicates with fluid supply passages communicating with a plurality of master piston bores.

8. The lost motion system of claim 1 further comprising a pressurized source of hydraulic fluid connected to the one or more hydraulic fluid passages, and wherein a bias force exerted by the bias piston spring on the bias piston is less than a pressure force exerted by the pressurized source of hydraulic fluid on the bias piston.

* * * * *